US008451074B2

(12) United States Patent
Erven

(10) Patent No.: US 8,451,074 B2
(45) Date of Patent: May 28, 2013

(54) SWITCH, IN PARTICULAR LOAD BREAKING SWITCH

(75) Inventor: Wolfgang Erven, Amberg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 13/083,645

(22) Filed: Apr. 11, 2011

(65) Prior Publication Data

US 2011/0248802 A1 Oct. 13, 2011

(30) Foreign Application Priority Data

Apr. 13, 2010 (DE) ..... 10 2010 015 286

(51) Int. Cl.
*H01H 75/00* (2006.01)
*H01H 77/00* (2006.01)
*H01H 83/00* (2006.01)

(52) U.S. Cl.
USPC ..... 335/16; 335/6

(58) Field of Classification Search
USPC ..... 335/6, 16
See application file for complete search history.

(56) References Cited

U.S. PATENT DOCUMENTS 4,409,573 A * 10/1983 Di Marco et al. ..... 335/16
5,029,301 A * 7/1991 Nebon et al. ..... 335/16
5,310,971 A * 5/1994 Vial et al. ..... 200/244
5,313,180 A * 5/1994 Vial et al. ..... 335/16
5,694,098 A * 12/1997 Mody et al. ..... 335/16
6,229,413 B1 * 5/2001 Castonguay et al. ..... 335/16
6,232,856 B1 * 5/2001 Boucher et al. ..... 335/16
6,392,512 B1 * 5/2002 Ferree et al. ..... 335/16
6,975,190 B2 12/2005 Sato et al.
2002/0050878 A1 * 5/2002 Ferree et al. ..... 335/16
2008/0012665 A1 * 1/2008 DeBoer et al. ..... 335/16

FOREIGN PATENT DOCUMENTS

DE 10347148 A1 5/2005
DE 102004051184 A1 9/2005
DE 102005021726 A1 11/2006
EP 1523020 A1 4/2005
EP 1912239 A1 4/2008
WO WO2006119938 A1 11/2006

OTHER PUBLICATIONS

Certified German Priority Application No. DE 10 2010 015 286.2 filed Apr. 13, 2010.

* cited by examiner

*Primary Examiner* — Alexander Talpalatski
(74) *Attorney, Agent, or Firm* — Harness, Dickey & Pierce, P.L.C.

(57) ABSTRACT

A load breaking switch including a rotor embodied as a switch shaft segment, and a contact arm pivotally mounted in the rotor pivotable between an ON and OFF position about an axis of rotation and at the free end of which is a contact piece which is pivotable with the contact arm and is in contact with an opposite fixedly arranged contact piece when the contact arm is in its ON position. Current flows through the switch via the contact pieces and the contact arm. The contact arm is pivotable into its OFF position when the current flowing via the contact pieces exceeds a rated current value or an overload current value. A magnetizable area is spatially arranged inside the rotor such that the current flowing through the contact arm in this area induces a magnetic field which exerts a torque on the contact arm.

16 Claims, 3 Drawing Sheets

SWITCH, IN PARTICULAR LOAD BREAKING SWITCH

Priority Statement

The present application hereby claims priority under 35 U.S.C. §119 on German patent application number DE 10 2010 015 286.2 filed Apr. 13, 2010, the entire contents of which are hereby incorporated herein by reference.

FIELD

At least one embodiment of the invention generally relates to a switch, in particular a load breaking switch.

BACKGROUND

Load breaking switches are generally known and are used for interrupting an electric current, in particular by an operator. For each phase of a multiphase power supply they have a rotor which is embodied as a switch shaft segment. A contact arm is pivotally mounted in each case in the rotor and is mounted so as to be pivotable at least between an ON and OFF position about an axis of rotation. At its free end the contact arm carries a contact piece which is movable together with the contact arm.

When the contact arm is in its ON position, i.e. the load breaking switch is switched on, the movable contact piece is in contact with an opposite fixedly arranged contact piece and the current flows through the switch via the two contact pieces and the contact arm. A spring force holds the contact arms in their ON position and presses the contact pieces firmly against each other.

Load breaking switches are designed so that they can be switched off at rated current or also at overload current up to a predefined value, for which purpose a correspondingly high current-carrying capacity is required. The current-carrying capacity is also determined by the contact force with which the contact pieces are pressed against each other. Appropriately dimensioned switch latching mechanisms are used in order to provide the necessary contact force.

The interconnected rotors form the load breaking switch's switch shaft which is actuated by a switch latching mechanism in order to effect the disconnection. The switch latching mechanism is pretensioned by a spring and is unlatched in order to effect the disconnection. After the unlatching all the contact arms are pivoted by the switch shaft against a spring force into their OFF position.

SUMMARY

In at least one embodiment of the invention, a load breaking switch is provided that is simpler in terms of its construction, yet nonetheless has a high current-carrying capacity.

The dependent claims represent advantageous embodiments.

The solution of at least one embodiment provides that a magnetizable area is spatially arranged inside the rotor in such a way that the current flowing through the contact arm in this area induces a magnetic field which in turn exerts a torque on the contact arm. The magnetizable area acts in this case as a force intensifier which increases the contact forces acting on the contact pieces. By this, it is possible to dispense with a more powerful switch latching mechanism, thereby enabling the load breaking switch to be used for carrying current.

A technically simple implementation provides that the area is formed by way of a magnetizable element, in particular an iron yoke.

It is easy in terms of manufacturing processes if the rotor is produced from plastic using the injection molding method and the magnetizable element is injected into the rotor wall.

BRIEF DESCRIPTION OF THE DRAWINGS

Further advantages, features and properties of the present invention are described in more detail below with reference to an example embodiment and the attached figures, in which.

DETAILED DESCRIPTION OF THE EXAMPLE EMBODIMENTS

Figure 1:
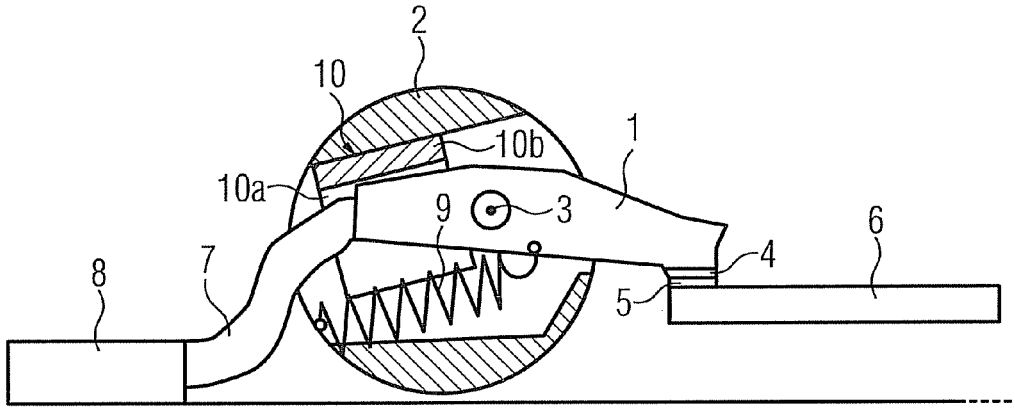
FIG. 1 shows a schematic representation of a load breaking switch with an iron yoke.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words' used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

FIG. 1 shows a schematic representation of a load breaking switch, referred to in the following as a switch. The switch is a multipole switch which can be connected on the line side to the three phases of a power supply. Associated with each phase is a contact arm 1 which is arranged in a pole cartridge.

The contact arm 1 is pivotally mounted between an ON and OFF position in a rotor 2 around an axis of rotation 3. At its right-hand (referred to FIG. 1) free end the contact arm 1 carries a contact piece 4 which in turn is in contact with a fixedly arranged contact piece 5 which is secured to a busbar 6. The other free end of the contact arm 1 is connected by way of a flexible wire 7 to a further busbar 8.

The current in FIG. 1 flows through the switch from the busbar 8 via the flexible wire 7 and the contact arm 1 onward via the two contact pieces 4, 5 and the busbar 6 (or vice versa). In the process the two contact pieces 4, 5 are pressed against each other by way of a spring 9, thereby providing part of the requisite contact force.

Also arranged in the rotor 2 manufactured from plastic injection molding is a magnetizable area 10 in the form of a magnetizable element 10*a* which in this case is embodied as an iron yoke 10*b*.

When a current flows through the switch and consequently through the contact arm 1, it generates a magnetic field around the contact arm 1. Said magnetic field induces a counter magnetic field in the iron yoke 1, said counter magnetic field pulling the left-hand (in FIG. 1) end of the contact arm 1 upward, causing the contact pieces 4, 5 to be pressed together with greater force. This torque provides the other part of the requisite contact force. The iron yoke 10*b* therefore intensifies the contact forces by exerting an additional torque on the contact arm 1.

In the case of currents in the rated current and overload current range the necessary contact force intensification is realized in this way.

Figure 2:
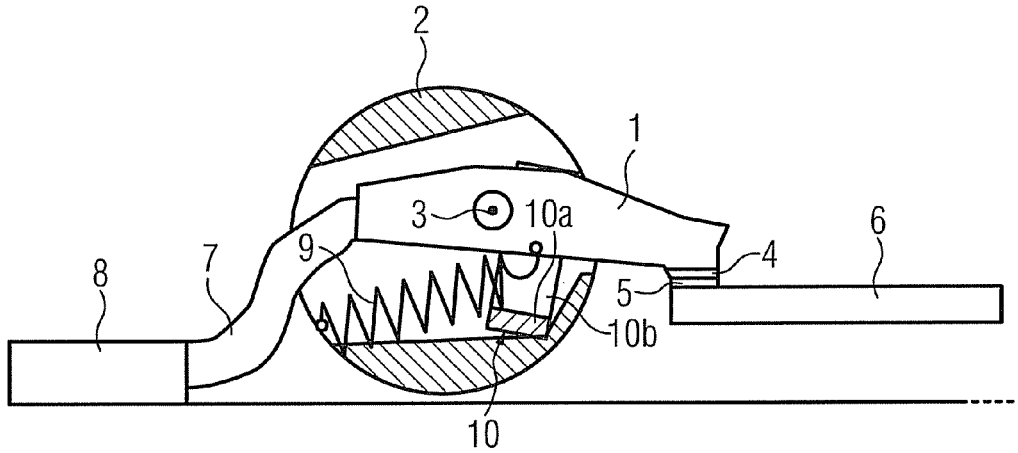
FIG. 2 shows a load breaking switch according to FIG. 1 with alternatively arranged iron yoke.

In contrast to the arrangement shown in FIG. 1, FIG. 2 shows an alternative embodiment in which the iron yoke 10*b* is arranged on the other side of the axis of rotation. In FIG. 2 the contact arm 1 is pulled downward by the iron yoke 10*b* and the contact pieces 4, 5 are pressed together. In this case, inversely to FIG. 1, the iron yoke 10*b* is located ahead of the pivot point of the axis of rotation 3, which makes sense if sufficient space is available in construction terms.

Viewed in the direction of the axis of rotation 3, the magnetizable area 10 is located on one side above or below the axis of rotation 3. Viewed vertically onto the axis of rotation 3, it can also be located on one side only of the axis of rotation 3. The critical point is that the induced magnetic field produces a sufficient contact force intensification.

Figure 3:
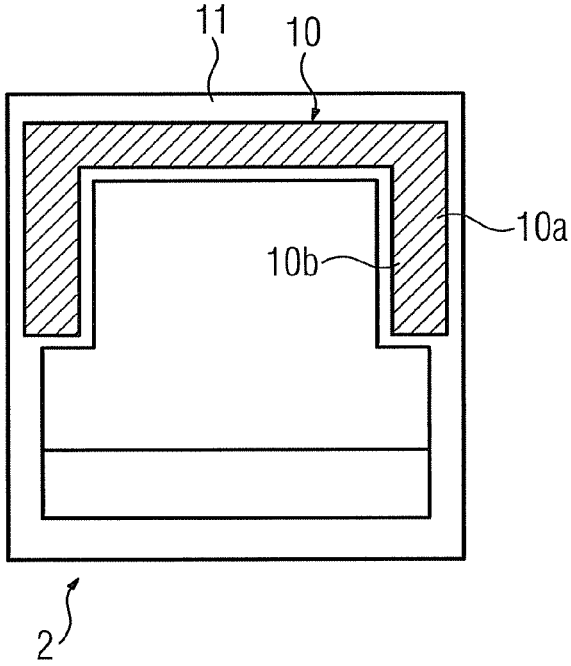
FIG. 3 shows a switch shaft of the load breaking switch according to FIG. 1 with injected iron yoke.

In the embodiment according to FIG. 3 the iron yoke 10*b* is injected into the rotor wall 11 of the rotor 2. Alternatively the iron yoke 10*b* can also be inserted from behind into the rotor wall in this case.

Figure 4:
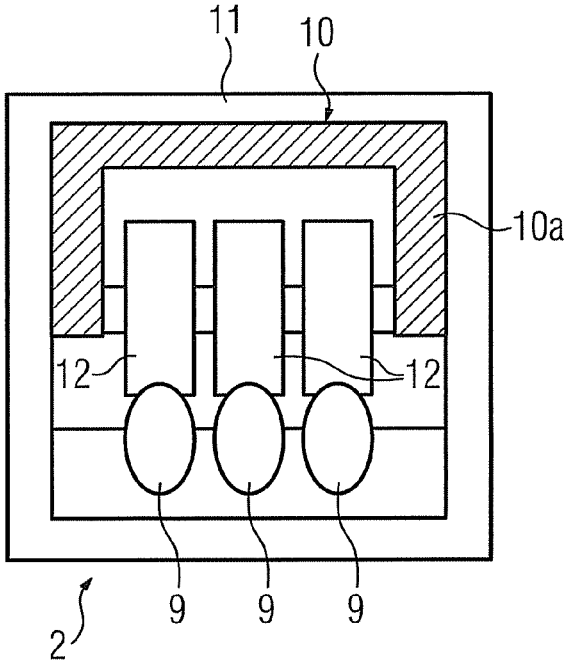
FIG. 4 shows the load breaking switch according to FIG. 1 with a plurality of contact fingers, viewed from the rear.

FIG. 4 shows the switch according to FIG. 1 in a rear view with a plurality of contact fingers 12.

Figure 5:
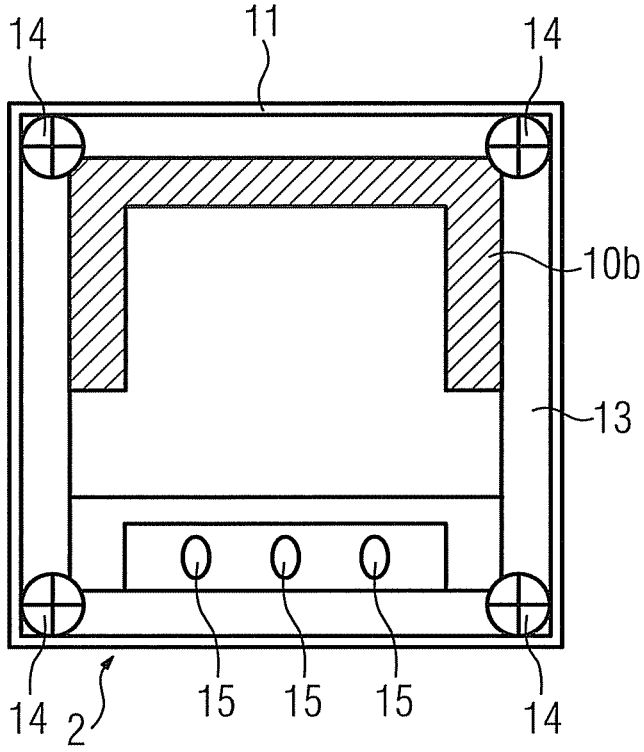
FIG. 5 shows a mounting of the iron yoke by way of a retaining plate seen from behind.

FIG. 5 shows a mounting for the iron yoke 10*b* by way of a retaining plate 13 which firstly accommodates the iron yoke 10*b* and secondly has eyelets 15 for the springs 9. The retaining plate 13 can be screwed on (screws 14) or else simply positioned or inserted, since the springs 9 can assume the retaining function. Because the iron yoke 10*b* in this case has a plate-like structure in order to avoid eddy current losses, the retaining plate 13 (the mounting bracket) effectively constitutes a special laminar sheet, such that the entire laminated-core iron yoke 10*b* can be connected by way of a common interconnect technology. The (integrated) retaining plate 13 creates the advantage of a common carrier for two functions and therefore represents a way of facilitating assembly and/or installation.

Figure 6:
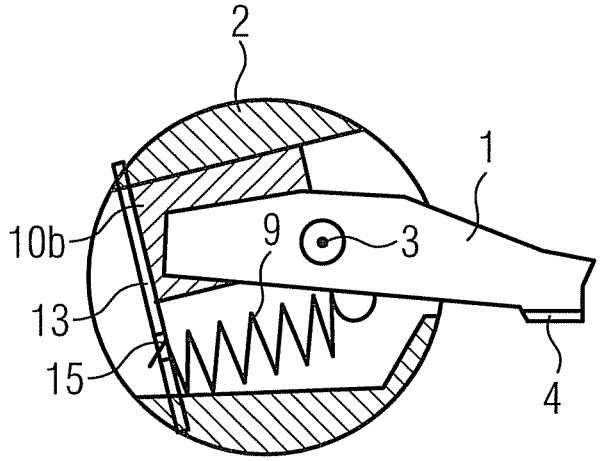
FIG. 6 shows a side view of the switch according to FIG. 5.

The front view of the switch according to FIG. 5 is shown in FIG. 6.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A switch, comprising:

a rotor;

a contact arm, pivotally mounted in the rotor and pivotable between an ON and OFF position about an axis of rotation, a contact piece, located at a free end of the contact arm, pivotable together with the contact arm and in contact with an opposite fixedly arranged contact piece when the contact arm is in its ON position, wherein a current flows through the switch via the contact pieces and the contact arm, wherein the contact arm is pivotable into its OFF position when the current flowing via the contact pieces exceeds a value, a n d wherein a magnetizable area is spatially arranged inside the rotor in such a way that the current flowing through the contact arm in the magnetizable area induces a magnetic field which in turn exerts a torque on the contact arm.

2. The switch as claimed in claim 1, wherein the magnetizable area is formed by a magnetizable element.

3. The switch as claimed in claim 2, wherein the rotor is manufactured from plastic using an injection molding method and wherein the magnetizable element is injected into a wall of the rotor.

4. The switch as claimed in claim 2, wherein, viewed in a direction of an axis of rotation of the contact arm, the magnetizable area is located on one side above or below the axis of rotation.

5. The switch as claimed in claim 2, wherein, viewed vertically onto an axis of rotation of the contact arm, the magnetizable area is located on one side of the axis of rotation.

6. The switch as claimed in claim 1, wherein the switch is a load breaking switch.

7. The switch as claimed in claim 1, wherein the rotor is embodied as a switch shaft segment.

8. The switch as claimed in claim 1, wherein the value is a rated current value or an overload current value.

9. The switch as claimed in claim 2, wherein the magnetizable element is an iron yoke.

10. The switch as claimed in claim 3, wherein, viewed in a direction of an axis of rotation of the contact arm, the magnetizable area is located on one side above or below the axis of rotation.

11. The switch as claimed in claim 3, wherein, viewed vertically onto an axis of rotation of the contact arm, the magnetizable area is located on one side of the axis of rotation.

12. The switch as claimed in claim 4, wherein, viewed vertically onto the axis of rotation of the contact arm, the magnetizable area is located on one side of the axis of rotation.

13. The switch as claimed in claim 1, wherein a free end of the contact arm is connected to a bus bar by way of a flexible wire.

14. The switch as claimed in claim 1, wherein the contact has a movable contact at only one free end of the contact arm.

15. The switch as claimed in claim 1, wherein the rotor and the magnetizable area rotate together.

16. The switch as claimed in claim 1, wherein the magnetizable area is fixed to the rotor.

* * * * *